United States Patent [19]

Johnson

[11] 3,987,704

[45] Oct. 26, 1976

[54] FLUID SYSTEM OF A WORK VEHICLE HAVING FLUID COMBINING MEANS

[75] Inventor: Howard L. Johnson, Joliet, Ill.

[73] Assignee: Caterpillar Tractor Co., Peoria, Ill.

[22] Filed: Feb. 27, 1976

[21] Appl. No.: 662,077

[52] U.S. Cl. ..... 91/412; 91/461; 60/421; 60/486

[51] Int. Cl.[2] ..... F15B 13/06; F15B 13/09

[58] Field of Search ..... 91/412, 461; 60/421, 60/486, 468

[56] References Cited

UNITED STATES PATENTS 2,616,264 11/1952 Grant et al. ..... 91/412

3,838,573 10/1974 Laumond ..... 60/486

*Primary Examiner*—Edgar W. Geoghegan

*Attorney, Agent, or Firm*—Frank L. Hart

[57] ABSTRACT

A fluid system for work elements of a work vehicle has first and second fluid circuits each having a pump connected to a work element through a control valve assembly that is operated by a pilot pump. A control means is provided for controllably passing fluid between the first and second fluid circuits in response to power demands of said circuits.

8 Claims, 4 Drawing Figures

20
28
24
86
"A"
10
36
74
"B"
106
92
46
102
98
32
90
16
12

FLUID SYSTEM OF A WORK VEHICLE HAVING FLUID COMBINING MEANS

BACKGROUND OF THE INVENTION

In order to reduce power requirements, materials, and labor of a work vehicle having a plurality of fluid pumps serving a plurality of fluid circuits each having at least one work element, it is desirable to provide means for controllably passing fluid between the fluid circuits in response to power demands of said circuits.

This invention therefore resides in a fluid system of work elements of a work vehicle having a pilot pump and first and second fluid circuits. Each of the first and second fluid circuits has a pump connected to a respective work element through a control valve assembly for controlling the flow of fluid from the respective pump to the respective work element and a primary pilot control valve positioned between the pilot pump and the respective control valve assembly for altering a pilot pump signal, delivering a resultant signal, and controlling the operation of the respective control valve assembly. A control means is provided for passing fluid between the first and second fluid circuits. The control means is responsive to preselected biasing forces and said resultant signals from the first and second primary pilot control valves.

DETAILED DESCRIPTION OF THE INVENTION

Figures 1, 4:
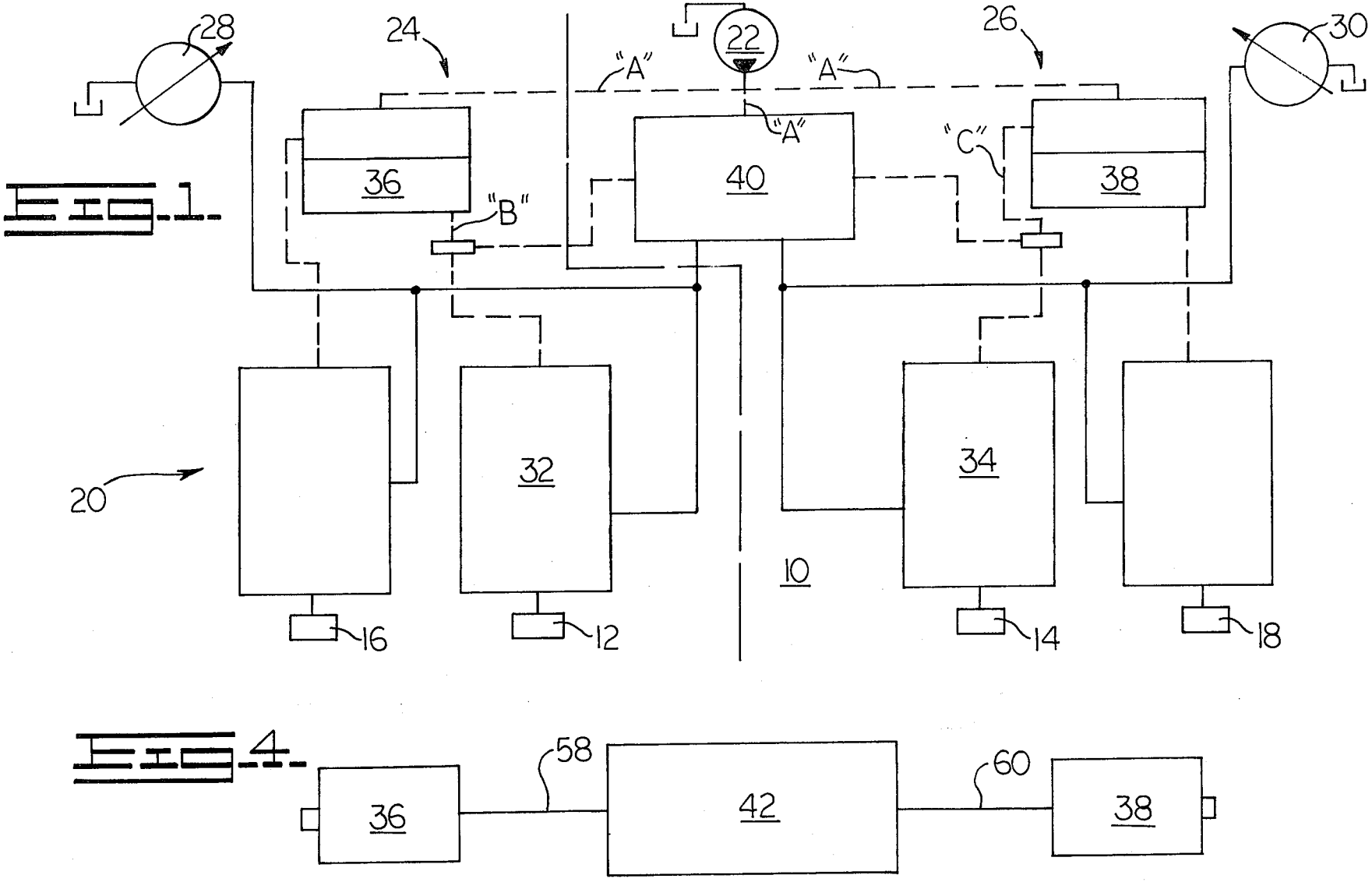
FIG. 1 is a diagrammatic general view of the apparatus of this invention.
FIG. 4 is a diagrammatic view of another embodiment of the signal means of FIGS. 1–3.

Referring to the general view of FIG. 1, a work vehicle 10 has a plurality of work elements 12,14,16,18 operably connected to a fluid system 20, preferably a hydraulic fluid system, of the work vehicle 10. The work vehicle 10, for example an excavator, has a pilot pump 22 and at least first and second fluid circuits 24,26, as better shown in FIGS. 2 and 3.

Each fluid circuit 24,26 has a fluid pump 28,30 connected to a respective work element 12,14 through a control valve assembly 32,34 for controlling the flow of fluid from the respective pump 28,30 to the respective work element 12,14. Each fluid circuit 24,26 also has a primary pilot control valve 36,38 positioned between the pilot pump 22 and the respective control valve assembly 32,34 for altering a pilot pump signal A, delivering a respective resultant signal B,C, and controlling the operation of the respective control valve assembly 32,34.

Control means 40 is provided for controllably passing fluid between the first and second fluid circuits 24,26 at a location between the first and second pumps 28,30 and their respective first and second control valve assemblies 32,34. The control means 40 is responsive to preselected biasing forces and the resultant signals B,C from the first and second primary pilot control valves 36,38. As hereinafter more fully described, each of the resultant signals B,C is of a magnitude responsive to the position of the respective primary pilot control valve 36,38.

Figure 2:
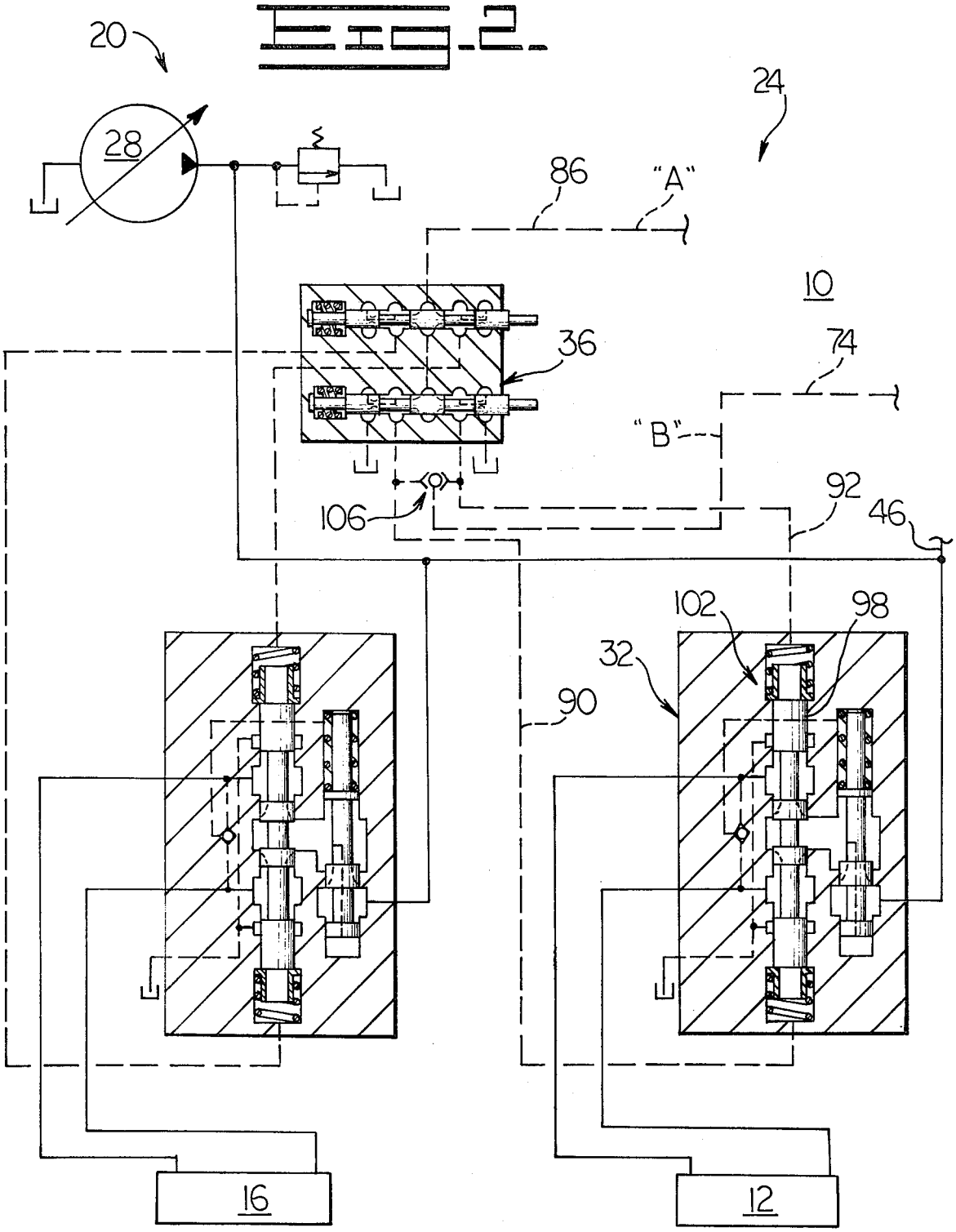
FIG. 2 is a diagrammatic, more detailed view of a first portion of the apparatus of FIG. 1.
Figure 3:
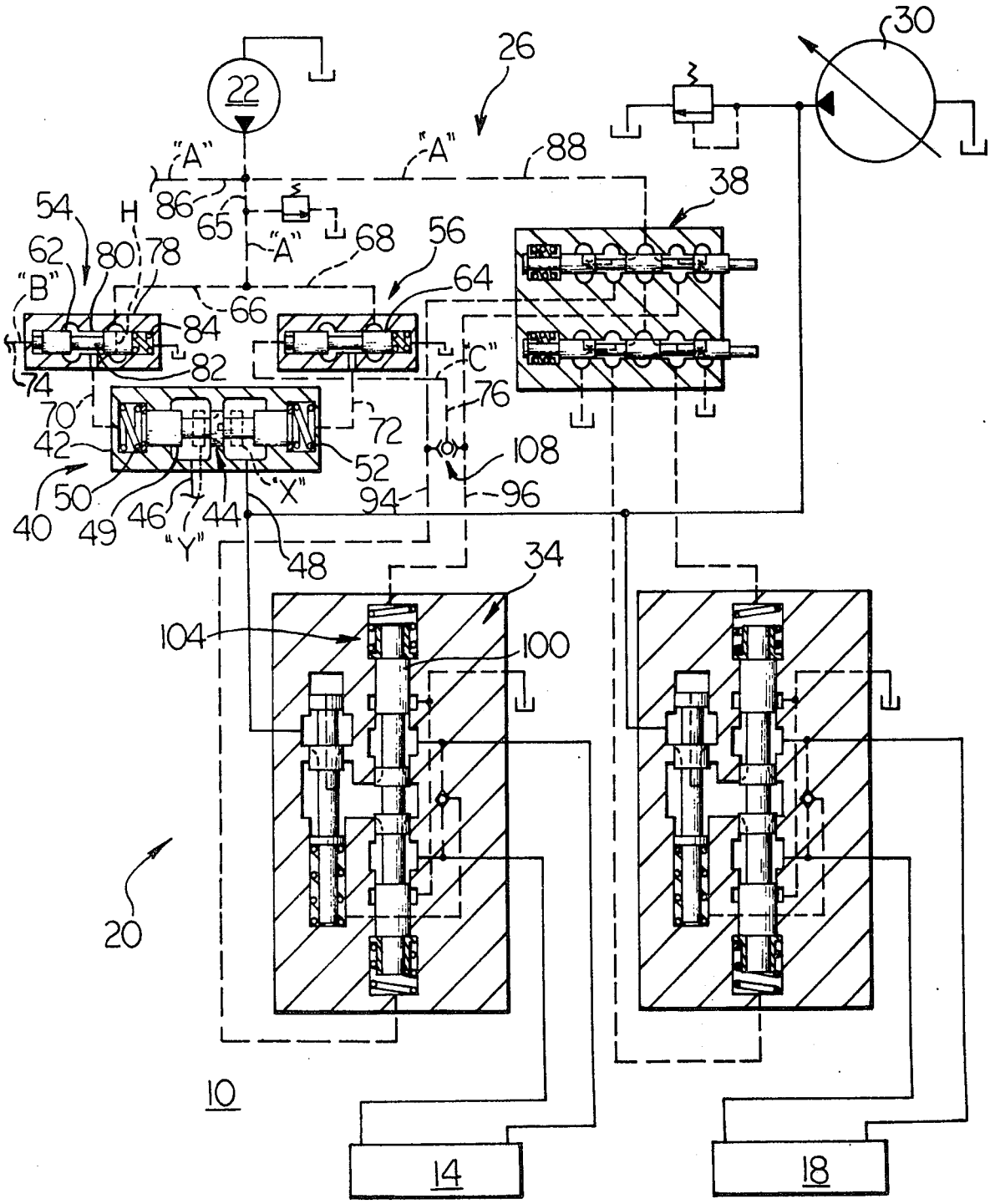
FIG. 3 is a diagrammatic, more detailed view of a second portion of the apparatus of FIG. 1.

Referring to FIGS. 2 and 3, the control means 40 has a housing 42 having a longitudinally extending chamber 44 that is in fluid communication with the first and second fluid circuits 24,26 via lines 46,48. A spool 49 is slidably positioned in the chamber 44 for movement between first position and second positions X and Y shown by broken lines at which the first and second circuits 24,26 are in communication through the chamber 44 and an intermediate position Z shown by solid lines at which the spool 49 is preventing communication of the first and second circuits 24,26.

First and second biasing elements 50,52 are positioned at opposed ends of the spool 49 for urging the spool respectively toward second and first positions. A first signal means 54 is provided for receiving the first resultant signal B and biasing the spool 49 toward the first position in response thereto and in opposition to the biasing force of the second biasing element 52. A second signal means 56 is provided for receiving the second resultant signal C and biasing the spool 49 toward the second position in response thereto and in opposition to the biasing force of the first biasing element 50.

Referring to FIG. 4, each signal means 54,56 is a conduit 58,60 connected at one end to the respective primary pilot control valve 36,38 and at the other end to the control means housing 42 adjacent and in fluid communication with an end of the spool 49.

Referring to FIGS. 2 and 3, each of the preferred signal means 54,56 has a secondary pilot control valve 62,64 connected to the pilot pump 22 via lines 65,66,68, to the control means housing 42 adjacent a respective end of the spool 49 via lines 70,72, and to a respective primary pilot control valve 36,38 via lines 74,76 for receiving respective resultant signals, B,C.

The secondary pilot control valves 62,64 are preferably of common construction and only valve 62 will be described for purposes of brevity.

Each secondary pilot control valve has a housing 78 having a chamber 80 in fluid communication with the pilot pump 22 and a respective end of the control means housing 42 via lines 66,70. A spool 82 is movably positioned in the chamber 80 and has one end in fluid communication with the respective resultant signal B. The spool 82 is movable through the chamber 80 between a first position, shown by broken line H in FIG. 3, at which the pilot pump 22 and said respective end of the control means spool 49 are in fluid communication and a second position, shown by solid lines, at which the spool 82 is preventing communication of the pilot pump 22 with said spool 49.

A biasing element 84 is provided for urging the spool 82 toward the second position in opposition to the respective resultant signal B.

A preferred construction of the apparatus of this invention has each primary pilot control valve 36,38 connected to the pilot pump 22 via respective lines 86,88 for receiving signal A. As is known in the art, each primary pilot control valve 36,38 alters signal A and delivers first and second control signals via respective lines 90,92 and 94,96 to opposed ends of a respective spool 98,100 of a respective directional control valve 102,104 of control valve assemblies 32,34 for the controlled operation thereof. In this construction, the respective resultant signal B,C is each preferably the larger of the respective first and second control signals passing through lines 90,92 and 94,96. A resolver valve 106,108 is connected to each respective line pair 90,92 and 94,96 for providing that the respective resultant signal B,C is the larger of their associated first and second control signals.

As is shown in the drawings, additional work elements 16,18, for example, can be connected to first and/or second fluid circuits 24,26 for operation thereby.

In the operation of the apparatus of this invention, the work elements can be a stick 12, boom 14, swing 16, and bucket 18 of an excavator. The magnitude of signal B is responsive to the fluid power demands of the first circuit 24 and the magnitude of signal C is responsive to the fluid power demands of the second circuit 26.

Under fluid demand conditions of both the first and second circuits 24,26, the spool 49 will be at the intermediate position Z and the fluid from one pump will not be comingled with the fluid from the other pump. However, where there is substantially no fluid demand by one circuit, the spool 49 will be urged toward its first or second position and fluid from the circuit requiring substantially no fluid will pass into the other fluid circuit and assist in supplying its fluid demands.

The apparatus of this invention is further controlled by providing secondary pilot control valves 62,64 in each circuit. In this construction, signals B and C are used to control a pilot control signal A and controllably pass signal A in response to the magnitude of respective signals B and C to the control means 40. Therefore, where the work elements of the associated circuit are demanding fluid, the associated signal B′ and C′ will prevent comingling of fluid between the circuits via control means 40 since full pilot pressure will be maintaining the spool 49 in its intermediate position.

Therefore, when one of the circuits is not demanding fluid, its associated pump will provide fluid through control means 40 to the other circuit but when both circuits are demanding fluid, fluid control means 40 will prevent passage of fluid between the fluid circuits.

Other aspects, objects, and advantages of this invention can be obtained from a study of the drawings, the disclosure, and the appended claims.

What is claimed is:

1. In a fluid system of work elements of a work vehicle having a pilot pump and first and second fluid circuits, each fluid circuit having a pump connected to a respective work element through a control valve assembly for controlling the flow of fluid from the respective pump to the respective work elememt and a pair of primary pilot control valves each positioned between the pilot pump and a respective control valve assembly for altering a pilot pump signal, delivering a resultant signal, and controlling the operation of the respective control valve assembly, the improvement comprising:

means for controllably passing fluid between the first and second fluid circuits, said means being responsive to preselected biasing forces and said resultant signals from the first and second primary pilot control valves.

2. Apparatus, as set forth in claim 1, wherein the control means comprises:

a housing having a chamber in fluid communication with the first and second fluid circuits;

a spool movable through the housing chamber between first and second positions at which the first and second circuits are in fluid communication through the chamber and having an intermediate position at which the first and second fluid circuits are free from fluid communication;

first and second biasing elements positioned at and biasing opposed ends of the spool;

first signal means for receiving the first resultant signal and biasing the spool toward the first position in response thereto; and second signal means for receiving the second resultant signal and biasing the spool toward the second position in response thereto.

3. Apparatus, as set forth in claim 2, wherein each signal means comprises:

a conduit connected at one end to the respective primary pilot control valve and at the other end to the control means housing adjacent an end of the spool.

4. Apparatus, as set forth in claim 2, wherein each signal means comprises:

a secondary pilot control valve connected to the pilot pump, the control means housing adjacent a respective end of the spool, and to a respective primary pilot control valve for receiving the respective resultant signal.

5. Apparatus, as set forth in claim 4, wherein each secondary pilot control valve comprises:

a housing having a chamber in fluid communication with the pilot pump and a respective end of the control means housing;

a spool having one end in fluid communication with the respective resultant signal and being movable through the chamber between a first position at which the pilot pump and a respective end of the control means spool are in fluid communication and a second position at which the pilot pump and control means spool are free from fluid communication; and a biasing element urging the secondary pilot control valve spool toward the second position in opposition to the resultant signal.

6. Apparatus, as set forth in claim 1, wherein the resultant signal of each primary pilot control valve is the larger of first and second control signals passing from the respective primary pilot control valve to the respective control valve assembly.

7. Apparatus, as set forth in claim 6, including:

a resolver valve connected to each primary pilot control valve at a location between the primary pilot control valve and the respective control valve assembly and being in communication with the first and second control signals of the primary pilot control valve for providing the resultant pressure signal.

8. Apparatus, as set forth in claim 1, wherein at least one of the fluid circuits has a plurality of work elements.

* * * * *